United States Patent [19]

Malmberg et al.

[11] Patent Number: 4,458,972

[45] Date of Patent: Jul. 10, 1984

[54] LOCKING DEVICE FOR CONNECTING MEANS

[75] Inventors: Karl G. Malmberg, Farsta; Jan A. Petersson, Solna; Adalbert G. Schneider, Norrtalje, all of Sweden

[73] Assignee: Telefonaktiebolaget L M Ericsson, Stockholm, Sweden

[21] Appl. No.: 285,387

[22] PCT Filed: Dec. 3, 1980

[86] PCT No.: PCT/SE80/00310

§ 371 Date: Jul. 20, 1981

§ 102(e) Date: Jul. 20, 1981

[87] PCT Pub. No.: WO81/01772

PCT Pub. Date: Jun. 25, 1981

[30] Foreign Application Priority Data

Dec. 18, 1979 [SE] Sweden ..... 7910435

[51] Int. Cl.[3] ..... H01R 13/627

[52] U.S. Cl. ..... 339/91 R; 339/198 H

[58] Field of Search ..... 339/91 R, 198 G, 198 H, 339/198 J; 403/292; 46/26

[56] References Cited

U.S. PATENT DOCUMENTS

| | | | |
|---|---|---|---|
| 2,765,581 | 10/1956 | Adler | 403/292 |
| 3,822,499 | 7/1974 | De Vos | 46/26 |
| 4,012,100 | 3/1977 | Viscosi | 339/198 H |
| 4,159,592 | 7/1979 | Gabriel | 46/26 |

FOREIGN PATENT DOCUMENTS

| | | | |
|---|---|---|---|
| 2024508 | 12/1971 | Fed. Rep. of Germany | 403/292 |
| 2210844 | 9/1973 | Fed. Rep. of Germany | 339/91 R |
| 2165037 | 9/1974 | Fed. Rep. of Germany . | |
| 2714409 | 10/1978 | Fed. Rep. of Germany | 339/91 R |
| 2408232 | 6/1979 | France | 339/91 R |

*Primary Examiner*—John McQuade

*Attorney, Agent, or Firm*—Roberts, Spiecens & Cohen

[57] ABSTRACT

The invention relates to a device in a telecommunication system for connecting a first connecting units to a second connecting means, each comprising a connection block and a cover, to lock the connecting units to each other to form a bus member, and for connecting the bus member or either of the connecting units to the front edge of a circuit board or to the back plane of a magazine containing circuit boards. Each cover (2) is provided with a plurality of channel-like through recesses (2), so-called locking holes, along one long side. Lamellar locking springs (7) are insertable into these locking holes. The locking springs are formed with a wide and a narrower portion, the narrower portion being insertable from one side of the cover and retained by resilient snap action. The narrower portion of the locking spring projects in approximately to the middle of the locking hole, and the wide portion projects outside the front edge of the cover. The locking hole (2) is provided with a locking protuberance (6) at its rear edge. When connecting a first connecting units, the cover of which is provided with locking springs (7) to a second connecting means, the first portion of the locking spring lying outside the locking hole (2) on the first connecting units is inserted into the rear portion of the locking hole in the second connecting units, the locking protuberance (6) in the locking hole engaging, by resilient snap action in a recess (12) in the locking spring (7) to lock the connecting units to each other. On two sides of the recess (12) the locking spring is provided with sloping surfaces (13) which, when a locking spring is inserted into a locking hole without a locking protuberance, permits a solid but unlocked attachment by friction between the locking hole edge and the sloping surfaces.

6 Claims, 5 Drawing Figures

LOCKING DEVICE FOR CONNECTING MEANS

FIELD OF THE INVENTION

The invention relates to a device in a telecommunication system, adapted for operation when connecting a first connecting means to a second connecting means, each comprising a connection block and a cover, to lock the connecting means to each other to form a bus member, and for connecting said bus member or either of said connecting means to the front edge of a circuit board or to the back plane of a magazine containing circuit boards.

DESCRIPTION OF PRIOR ART

In known devices, for example as is apparent of Philips data handbook from April 1978, Components and Materials, part 10, Connectors, catalogue number 433202625920, metal locking devices mounted outside the covers are utilized for locking, the locking device being supplemented by some kind of receiving means on the circuit board edge or in the back plane.

SUMMARY OF THE INVENTION

The problem with the known devices is that the locking devices often have poor flexibility, i.e. they cannot be used for locking attachment between bus members as well as being utilized for non-locking attachment to the edge of a circuit board or in the back plane of a circuit board magazine. A locking device of the known type is furthermore expensive to produce.

The device in accordance with the invention is characterized by solving the problem by providing the cover with special locking holes in which lamellar locking springs, made from plastic, are insertable. The locking holes are arranged as through channel-like recesses in the transverse direction of the cover. The locking springs are formed with a wide and a narrower portion, the narrower portion being insertable from one side of the cover and retained by a resilient snap-on action. The narrower portion of the spring projects in approximately to the middle of the locking hole, and the wide portion projects outside the front edge of the cover. At its back edge, the locking hole is provided with a locking protuberance. In connecting a first connecting means the cover of which is provided with locking springs, to a second connecting means, that portion of the locking springs lying outside the locking hole on said first connecting means are pushed into the rear portion of the locking hole in said second connecting means, said locking protuberance in the locking hole engaging in a recess in the locking spring by resilient snap action to lock the connecting means to each other. As will be explained in conjunction with an embodiment, the locking springs are also formed so that a positive but non locking connection between said connecting means and the front edge of a circuit board or the back plane of a circuit board magazine can be obtained.

The advantages with the device in accordance with the invention as compared with known devices is that the locking device will be substantially simpler and can be manufactured at lower cost by it being made of a plastic material. Most important is, however, that a flexible locking device is obtained which can be used both for rigid locking when arranging bus members and also for unlocked attachment to circuit boards or the back plane in a circuit board magazine.

BRIEF DESCRIPTION OF THE DRAWING

The device in accordance with the invention will now be described in detail with the aid of an embodiment, while referring to the appended drawing, in which.

PREFERRED EMBODIMENT

Figure 1:
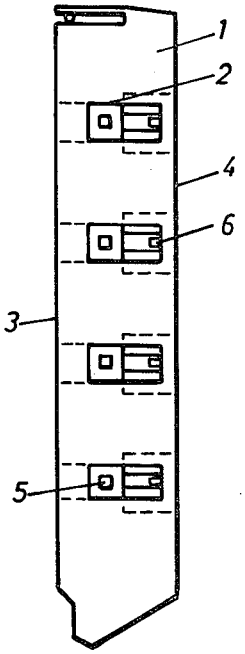
FIG. 1 illustrates a cover seen from one side with locking holes but without locking springs.
Figure 2:
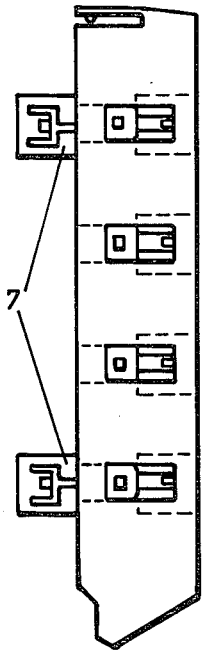
FIG. 2 illustrates the cover seen from one side with locking springs arranged in the locking holes.
Figure 5:
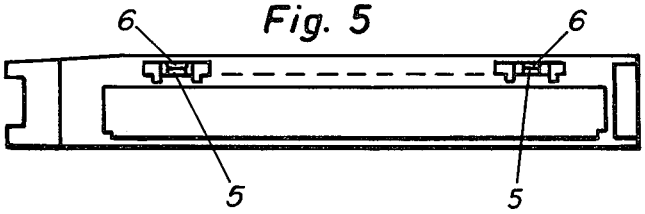
FIG. 5 illustrates the appearance of the locking holes from the rear of a cover, i.e. the back portion of the locking hole.
Figure 3:
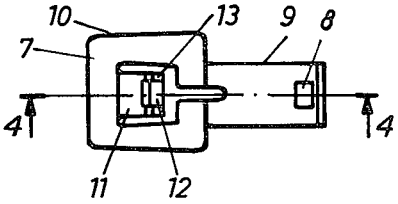
FIG. 3 illustrates a locking spring seen from above.
Figure 4:
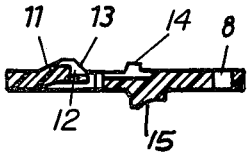
FIG. 4 is a sectional view of a locking spring taken along line 4—4 in FIG. 3

As will be seen from FIG. 1, a cover 1 is provided with a plurality of channel-like holes or recesses 2 running right through the cover, designated hereinafter as locking holes. The locking holes are accessible from the front edge 3 of the cover at the left in the figure, and from its back edge 4 at the right on the figure. The locking holes are made in the cover wall along one long side and are provided with a stud 5 and a locking protuberance 6. In FIG. 2 is illustrated how locking springs 7 are thrust into two of the locking holes 2 and retained by resilient snap action of the stud 5 in a hole 8 intended for the stud in the locking spring. FIG. 3 illustrates a locking spring 7 seen from above. As will be seen, the locking spring is formed with a narrower portion 9 and a wider portion 10. The narrower portion 9 is intended to be inserted into the locking hole 2 from the front 3 of a cover, i.e. that side of the cover from which its own connection block is inserted. A hole 8 in said narrower portion of the locking spring is, as previously mentioned, intended to receive the stud 5 in the locking hole. The wide portion 10 of the locking spring is intended for insertion into the locking hole 2 from the rear 4 of the cover 1. Said wide portion or tongue of the locking spring 7 has a resilient portion 11 provided with a recess 12, said portion 11 projecting slopingly from the surface of the locking spring. FIG. 4 illustrates the locking spring seen from one side. In order clearly to show how the locking spring is formed, certain portions are illustrated in cross section in the section 4—4. FIG. 5 illustrates a cover 1 seen from the rear. The figure is simplified and is only intended to show the appearance and location of the locking holes. Since it is from this side of the cover that the wide portion 10 of the locking spring is inserted, the locking hole is also wider on this side than it is on the front, where the narrower portion 9 of a locking spring is intended to be inserted. The number of locking holes and locking springs can be varied with the size of the connecting means. In the selected example, two locking springs are utilized, which is sufficient for this type of connecting means and for the use in question.

In coupling together two connecting means to a so-called bus member, it is achieved that the signals distributed to a circuit board by a first connecting means can be distributed, by connecting a further connecting means on top of said first connecting means to the next circuit board in a series of circuit boards etc. When such a bus member is desired, a second connecting means provided with locking springs 7 is coupled to a first connecting means provided with locking holes 2. On inserting the locking springs in the locking holes, said resilient portion 11 of the locking spring is compressed, so that when the locking spring is thrust in completely, it reassumes its original position, said locking protuberance 6 in the locking hole engaging in the recess 12 in the locking spring to lock the connecting means to each other. A tool is required to separate the connecting means from engagement with each other.

As will be seen from FIGS. 3 and 4, the locking spring is formed with sloping surfaces 13 at the sides of said recess 12. These sloping surfaces have the task of enabling a positive but not locking attachment, when either a complete bus member or the connecting means are to be connected individually to a circuit board or to the back plane in a circuit board magazine. The procedure here is that a receiving locking hole in the circuit board edge or back plane is not provided with any locking protuberance which can engage in the recess 12 of the locking spring, but only has a straight edge. When inserting a locking spring into such a locking hole, the resilient portion 11 of the spring is compressed as previously and springs out again when the locking spring is thrust home. Since no locking protuberance engages in the recess 12 of the locking spring, the locking spring is only retained in the locking hole by the pressure against the locking hole edge obtained by the return resilience of the resilient portion 11. When the connecting means is to be released from the circuit board, this is easily done by removing the connecting means by hand, the sloping surfaces 13 having a slope angle such that when pressed against the locking hole edge they glide along it and provide the downward pressure on said resilient portion 11 of the locking spring which thereby glides out ot the locking hole. In FIG. 4 are seen stop means 14 and 15 on the upper and lower surfaces of the locking spring for preventing over-insertion of the locking spring into the locking holes 2.

From what has been said above it will be apparent that the described locking spring can be used both in locking attachment between two connecting means and for positive but unlocking attachment at the front edge of a circuit board.

With the device in accordance with the invention there is thus obtained a technically simpler, more flexible and less expensive solution to the problem than in known devices, this also being the object of the invention.

What we claim is:

1. Connection apparatus in a telecommunicating system comprising an elongated cover member of a connector for a telecommunicating system, said cover member having front and rear longitudinal edges, said cover member being provided with transverse holes of channel shape extending therethrough in spaced relation longitudinally of said cover member, and a resilient locking spring member insertable into said holes at said front and rear edges and including means for engaging said cover member with snap action upon insertion at said front edge to retain said spring member in said cover member, said cover member including a locking protuberence in each hole, said spring member comprising a resilient portion including a tongue having a free end provided with a recess engageable by said protuberance when the spring member is inserted into the hole from said rear edge to rigidly lock the members together whereby two cover members can be connected together by said spring member.

2. Connection apparatus as claimed in claim 1 wherein said resilient portion projects at an angle from said spring member.

3. Connection apparatus as claimed in claim 2 wherein said resilient portion has sloped surfaces laterally adjoining said recess in the spring member for frictional engagement when inserted into a receiving hole without a locking protuberance.

4. Connection apparatus in a telecommunicating system comprising an elongated cover member of a connector for a telecommunicating system, said cover member having front and rear longitudinal edges, said cover member being provided with transverse holes of channel shape extending therethrough in spaced relation longitudinally of said cover member, and a resilient locking spring member insertable into said holes at said front and rear edges and including means for engaging said cover member with snap action upon insertion at said front edge to retain said spring member in said cover member, said cover member including a locking protuberance in each hole, said spring member being provided with a recess engageable by said protuberance when the spring member is inserted into the hole from said rear edge to rigidly lock the members together whereby two cover members can be connected together by said spring member, said spring member including a wide section and a narrow section, said narrow section being inserted into said holes in the cover member from said front edge whereas said wide section is inserted from said rear edge.

5. Connection apparatus as claimed in claim 4 wherein said narrow section has a free end and said means for engaging said cover and spring members with snap action comprises a stud on said cover member in each hole therein and an aperture at said free end of the narrow section of the spring member for receiving said stud when the narrow section is inserted into the hole in the cover member.

6. Connection apparatus as claimed in claim 5 wherein said spring member is made of a plastic material.

* * * * *